US006523724B2

(12) United States Patent
Paulovich et al.

(10) Patent No.: US 6,523,724 B2
(45) Date of Patent: Feb. 25, 2003

(54) CONTAINER

(75) Inventors: John Michael Paulovich, Hewitt; Edward John Giblin, Hopatcong, both of NJ (US); Richard Chalmers, Crystal Lake, MI (US); Corinne Saso, Ridgefield Park, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/749,957

(22) Filed: Dec. 28, 2000

(65) Prior Publication Data

US 2002/0084294 A1 Jul. 4, 2002

(51) Int. Cl.[7] ..... B67D 5/00

(52) U.S. Cl. ..... 222/189.09; 222/482; 215/261; 215/308; 220/371; 220/373

(58) Field of Search ..... 222/189.09, 487.5, 222/482; 215/261, 308; 220/371, 373

(56) References Cited

U.S. PATENT DOCUMENTS

| | | | | |
|---|---|---|---|---|
| 3,521,784 A | | 7/1970 | Gaines et al. | |
| 3,951,293 A | | 4/1976 | Schulz | |
| 4,765,499 A | | 8/1988 | Von Reis et al. | |
| 4,811,870 A | * | 3/1989 | Bianco | 222/482 |
| 4,863,051 A | | 9/1989 | Eibner et al. | |
| 5,117,999 A | | 6/1992 | Canzano et al. | |
| 5,176,271 A | | 1/1993 | Painchaud et al. | |
| 5,407,087 A | | 4/1995 | Giblin et al. | |
| 5,460,282 A | | 10/1995 | Giblin et al. | |
| 5,579,936 A | | 12/1996 | Costa et al. | |
| 5,657,891 A | | 8/1997 | Bilani et al. | |
| 5,692,634 A | | 12/1997 | Jenkins et al. | |
| 5,730,306 A | * | 3/1998 | Costa et al. | 215/261 |
| 5,853,096 A | * | 12/1998 | Bartur et al. | 215/261 |
| 5,882,454 A | * | 3/1999 | Baginski et al. | 215/261 |
| 5,901,867 A | | 5/1999 | Mattson | |
| 5,988,414 A | | 11/1999 | Schwarz et al. | |
| 5,988,426 A | | 11/1999 | Stern | |
| 5,988,448 A | * | 11/1999 | Fith | 222/189.09 |

FOREIGN PATENT DOCUMENTS

| | | |
|---|---|---|
| DE | 9217614 | 4/1993 |
| FR | 1357064 | 2/1963 |

OTHER PUBLICATIONS

Gore Brochure, copyright 1999: "For household cleaners and laundry detergents". Duravent container vents featuring Gore–TEX Membrane.

* cited by examiner

*Primary Examiner*—J. Casimer Jacyna
(74) *Attorney, Agent, or Firm*—Gerard J. McGowen, Jr.

(57) ABSTRACT

The present inventors have discovered a new vent which can be used in a venting closure and particularly in venting closures for large heavy duty liquid detergent and other liquid laundry product containers. In one embodiment, the vent comprises a wall, a vent opening in the wall, and one or more spacers on the surface of a face of the wall. Most especially the spacers are protuberances, especially rounded protuberances. A liner is adhered to a portion of the surface of the face and spaced from the vent opening by the spacers. The liner is made of a material which permits air to pass through the vent hole, but preferably, the liner material does not permit liquids to pass through the vent hole. In an especially preferred embodiment, the liner is comprised of a tetrafluoroethylene polymer. In a most preferred embodiment the application is also directed to a venting closure.

18 Claims, 12 Drawing Sheets

10
44
10
42
46
58
56
410
52
40
22
48
50
22
60
26
28
36
20

FIG.10
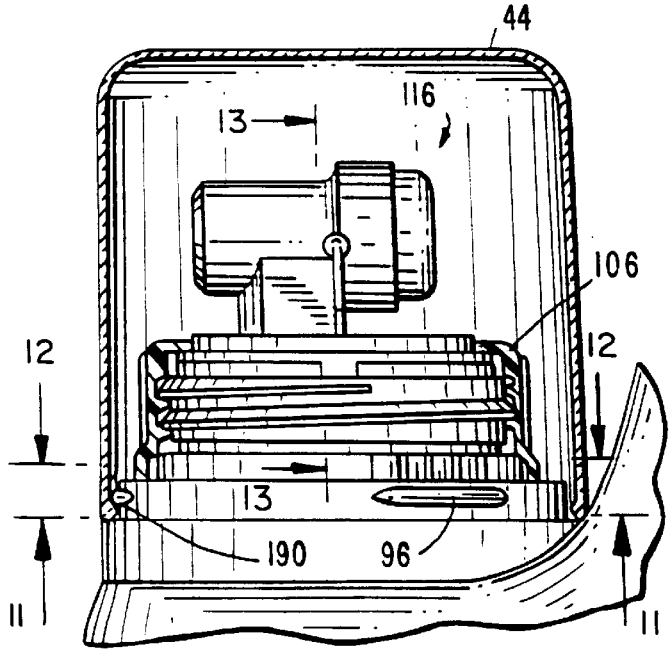
FIG.11
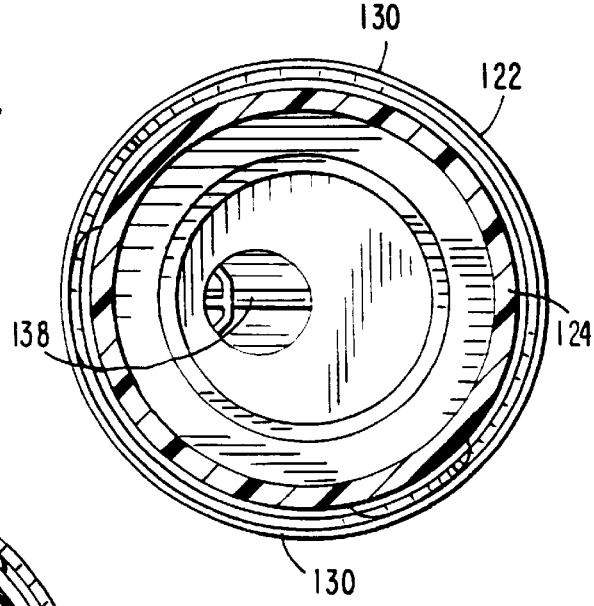
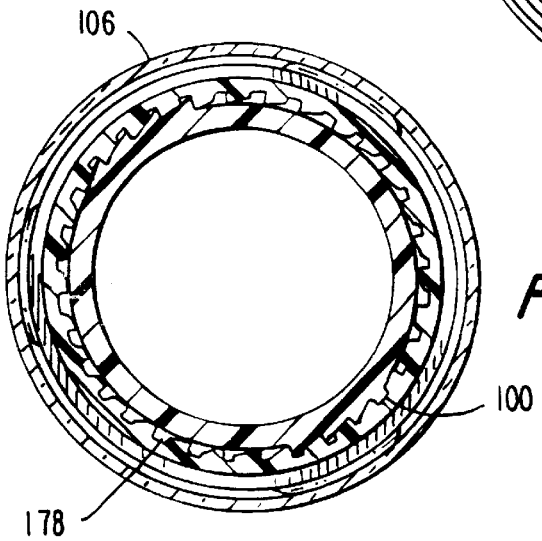
FIG.12

CONTAINER

BACKGROUND OF THE INVENTION

There has been a surge in popularity of the so-called "club" stores wherein consumers often purchase goods in larger quantities than has typically been the custom. The popularity of these outlets and the increased demand for larger volume units for selling consumer products has led to a need for improved packaging.

The need for updated packaging is particularly difficult to satisfy for heavy duty liquid detergents and other liquid consumer products since the weight of the enhanced volume of liquid product poses formidable challenges to the packaging engineer. For instance, despite its larger size the package must still permit convenient dispensing by consumers, who range in age from children through middle aged adults and up into the older population. In addition, with the larger volume of liquid product, the difficulties in ensuring structural integrity of the package are markedly increased. Moreover, it is desirable to provide such packaging at a low cost to consumers.

Various containers for carrying larger volumes of liquids by consumers are known.

Prior to the invention of the present invention, the package of Gerhart et al., U.S. Ser. No. 09/350,476 was available to various members of the public without confidentiality restrictions. That package was a 300 oz. Container which includes one or more top walls having a vent opening and closure, a handle, a spigot for releasing product, and a measuring cap which serves as a closure for the spigot.

While this container has been well received, a disadvantage is that venting of the container requires partial unscrewing of the vent cap, and in the event that the bottle is transported or otherwise moved while the vent cap is not securely fastened, the possibility of product inadvertently escaping from the package exists.

Schulz, U.S. Pat. No. 3,951,293 discloses a gas permeable liquid closure for containers of liquids or solids which emit or absorb gas. The closure includes a gas permeable film of unsintered tetrafluoroethylene. The film is supported across an opening of the container by a perforated cap or perforated sealing diaphragm. The vent stopper of the '293 patent is said to be suitable for containers of all kinds. The gas permeable material is an unsintered tetrafluoroethylene polymer with a fibrillatted structure and a density of less than about 1.4. It may be suitable to support the film to be used on one or both sides by supporting members such as perforated disks, diaphragms, lattices, meshes or grates or the like. Holding devices can have distinct profile rings. In FIG. 3, the disk of unsintered tetrafluoroethylene polymer with a fibrillated structure and a density of less than about 1.4 is held only by ring-shaped ridges and practically the entire surface of the disk is available for the passage of gas without coming in contact in the center with the cover bottom or the lockable core.

Baginski et al., U.S. Pat. No. 5,882,454 discloses a venting cap with a hole and a semi-permeable membrane. The membrane is fitted in a housing of particular dimensions which is in turn fitted in a protrusion corresponding to the hole in the caps. The membrane is understood to be sufficiently permeable to gases which may be generated inside the container in order to allow the gases to escape to the ambient and sufficiently impermeable to the substance contained in the container in order to prevent significant leakage, preferably all of leakage. Suitable materials are said to include polyethylene, high and low density, polypropylene, nylon and PTFE. Preferred materials are polyethylene film sold under the trademark Tyvek and an acrylic copolymer cast on a non-woven support with a fluoro monomer post treatment sold under the trademark Versapor. The housing and the protrusion may be simply glued together, spin welded or interference fitted together. The cap may have a top wall and a depending skirt. Stern, U.S. Pat. 5,988,426 discloses a disposable plastic lid formed with a vent hole. A filter formed of a material such as polytetrafluoroethylene is mounted over the vent hole.

Jenkins et al., U.S. Pat. No. 5,692,634 is directed to a rigid container structure for hermetic sealing of particulate solids which emit an off gas during containment. The chamber space is enclosed with a gas permeable imperforate membrane so as to selectively separate and retain an off gas out of contact with container contents. In FIGS. 8 and 9, a lattice arrangement is illustrated.

Eibner, U.S. Pat. No. 4,863,051 discloses a lid for a container for gas releasing liquids which includes a sealing cap having an opening closed by means of a foil of gas permeable, but liquid non-permeable material.

Bartur et al, U.S. Pat. No. 5,853,096 is directed to a pressure equalizing and a foam eliminating cap having a disk made of gas permeable material which is sized so it fits within the annular seal.

Schwarz et al., U.S. Pat. No. 5,988,414 discloses a lid having a pressure compensation device comprising a gas permeable, liquid impermeable membrane. The membrane is integrated in an upper cover portion of the lid by injection molding.

Costa et al., U.S. Pat. No. 5,730,306 is directed to a dual cap lining or bi-directional venting which includes a disk shaped gas permeable material bottom layer and a polyethylene material top layer which is provided with apertures which communicate with the bottom layer.

Costa et al., U.S. Pat. No. 5,579,936 is directed to a dual cap lining for bi-directional venting comprising a gas permeable material bottom layer having an extruded polyethylene material top layer which is provided with channels. The material of the bottom layer is gas permeable such that the dual lining allows bi-directional gas flow therethrough for gases which have built up in the interior of the container, and reverse venting to equilibrate for relatively increased external pressure.

Other closure patents of interest include Mattson, U.S. Pat. No. 5,901,867, Von Reis et al., U.S. Pat. No. 4,765,499, Painchaud et al., U.S. Pat. No. 5,176,271, Gaines et al., U.S. Pat. No. 3,521,784, Canzano et al., U.S. Pat. No. 5,117,999, and Bilani et al., U.S. Pat. No. 5,657,891.

SUMMARY OF THE INVENTION

The present inventors have discovered a new vent which can be used in a venting closure and particularly in venting closures for large heavy duty liquid detergent and other liquid laundry product containers. In one embodiment, the vent comprises a wall, a vent opening in the wall, and one or more spacers on the surface of a face of the wall. Most especially the spacers are protuberances, especially rounded protuberances. A liner is adhered to a portion of the surface of the face and spaced from the vent opening by the spacers. The liner is made of a material which permits air to pass through the vent hole, but preferably, the liner material does not permit liquids to pass through the vent hole. In an especially preferred embodiment, the liner is comprised of a tetrafluoroethylene polymer.

The application is also directed to a venting closure. In a first embodiment, the liner is friction fit and held at least in part by a wall which extends downwardly from a top wall of the closure. In another embodiment, the venting closure includes a liner which is spaced from the venting opening by spaces and is adhered to a portion of an inner face surface of the venting opening top wall.

In a still more preferred aspect of the invention, the venting closure is used in conjunction with a large volume heavy duty liquid detergent container. The container of the invention comprises a dispensing opening, a top wall, a side wall, a bottom wall, a container venting opening in at least one of the top and side walls, and a venting closure adapted to close the venting opening, wherein the closure includes a top closure wall, one or more spacers on an inner wall face of the top closure wall, a depending cylindrical side wall adjacent the inner face, a liner spaced from the venting opening by spacers adjacent the inner face, the liner being of a material which permits air to pass through the vent hole, the liner being partly adhered to the inner face surface.

In another embodiment, the container includes a top wall, a bottom wall and a container venting opening in at least one of the top and side walls, a venting closure, the venting closure including a top closure wall having an inner face and a liner adjacent the inner face, a spigot for releasing product from the product dispensing opening and a handle.

In a preferred embodiment, the top wall of the container includes the vent, the vent closure forming a closure for the vent, a handle, a pouring aperture and a pouring closure covering the pouring aperture. The top surfaces of the vent cap, the handle and the pouring closure are preferably generally parallel, and the height of the top surfaces of the vent cap and the pouring closure are preferably within an inch of the height of the top surface of the handle. The presence of generally parallel surfaces at the top of the container which are of the same or similar height promotes stacking of the shipping containers, since an uneven effective top surface of the container would tend to result in uneven distribution of stacking load. Preferably, the closure for the pouring aperture includes a measuring cup.

The top wall of the container preferably includes a handle extending from a handle base within the top wall. The handle is generally curved, which applicants anticipate will result in improved compressive strength. A pouring aperture is surrounded by a pouring aperture base which also extends from the top wall.

The container may comprise a valve assembly which preferably includes at least two separate pieces, (i) a valve and (ii) a collar for securing the valve to the container. The valve may include a base, a valve head, a valve stem and a resilient valve actuator.

For a more complete understanding of the above and other features and advantages of the invention, reference should be made to the following Detailed Description of Preferred Embodiments and to the accompanying drawings.

BRIEF DESCRIPTION OF THE DRAWINGS

FIG. 10 is a partial elevational view showing particularly the pouring opening, spigot and measuring cup/closure.

FIG. 11 is a cross section along the lines 11—11 of FIG. 10.

FIG. 12 is a cross section along the lines 12—12 of FIG. 10.

DETAILED DESCRIPTION OF THE INVENTION

Figure 1:
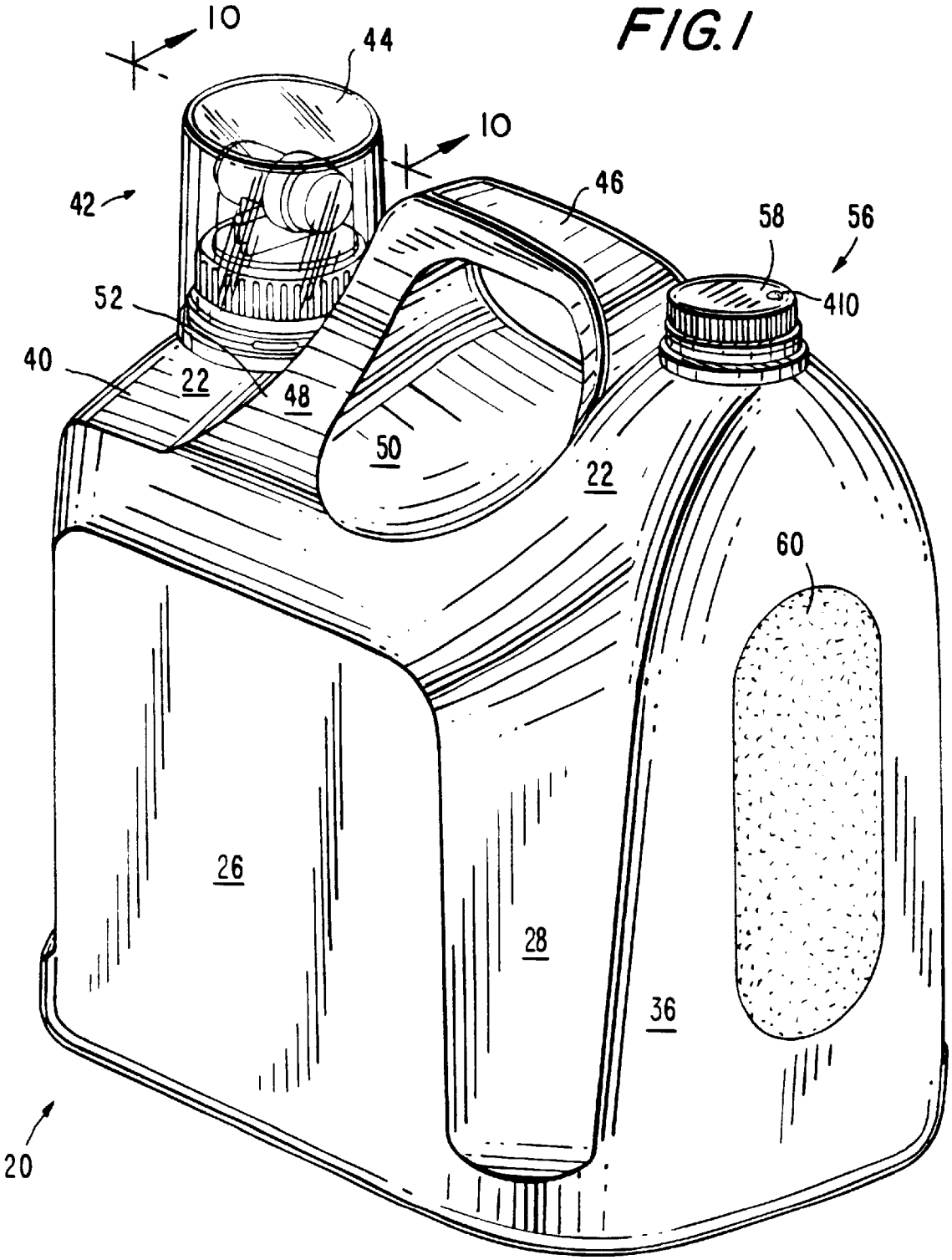
FIG. 1 is a perspective view of a container according to the invention.

Container or bottle 20 includes top wall 22, front wall 24, side walls 26, 28, 30, 32, 34 and 35, and rear wall 36.

Bottom wall 38 supports the container.

Top wall 22 includes a recessed area 40 in which is disposed valve or spigot apparatus 42 and closure/measuring cup 44, which will be described in greater detail below. Medially disposed with respect to valve or spigot assembly 42 is handle 46 which is integral with top wall 22. Handle 46 includes a base 48 having an interior aspect 50 and an exterior aspect 52. The interior of handle 46 is generally oval shaped as can be seen e.g., in FIG. 2.

Disposed laterally to handle 46 and on an opposite side from spigot assembly 42 is vent 56 and vent cap 58 with vent opening 300 in its top wall. The height of the highest point of wall 22 adjacent vent 56 is considerably higher than that in recessed area 40. Rear wall 36 includes oval etched area 60. The etching provides a non-uniform or rough surface for reasons which will be discussed below.

Figure 2:
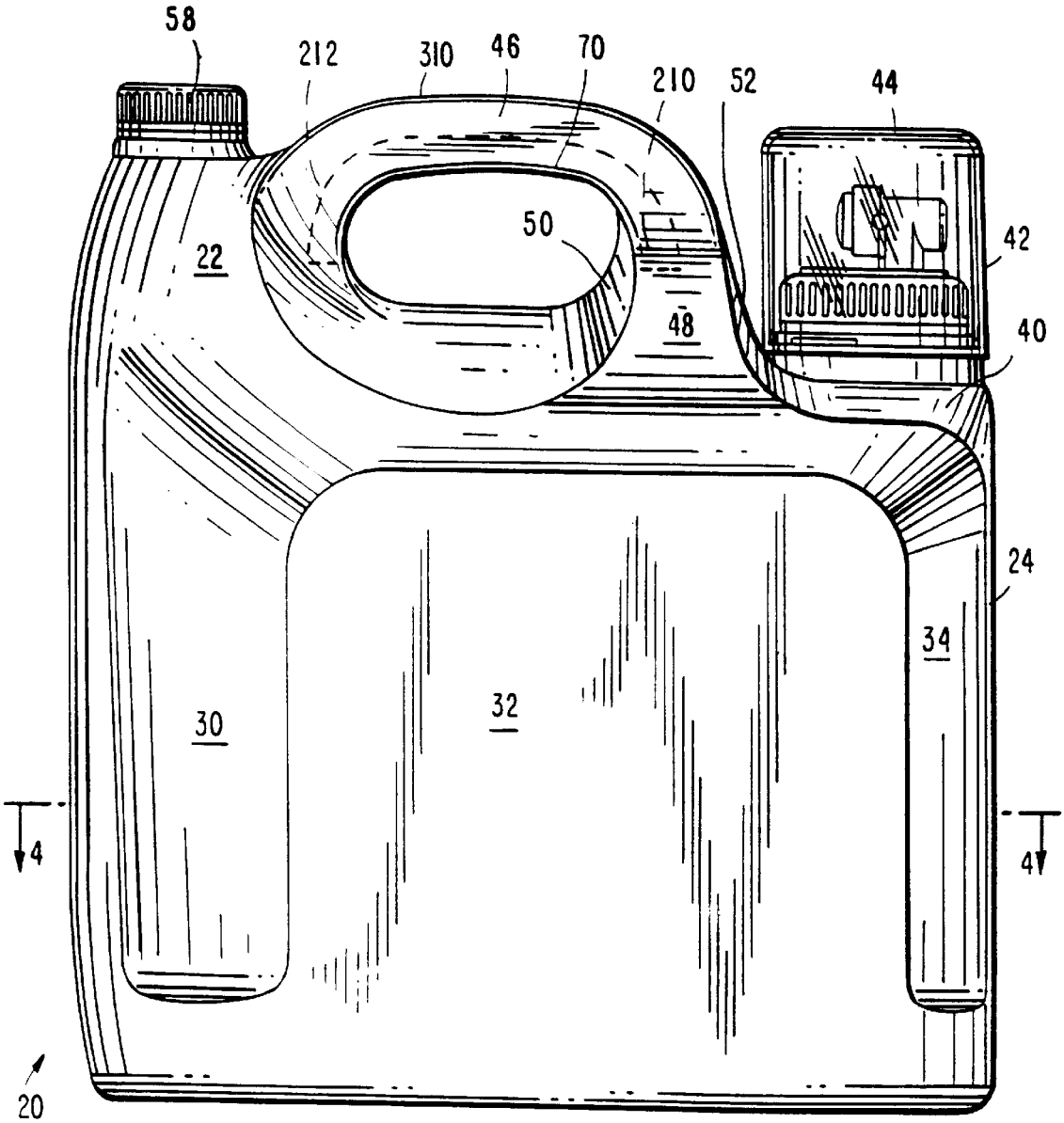
FIG. 2 is a side elevational view of the container of FIG. 1.
Figure 3:
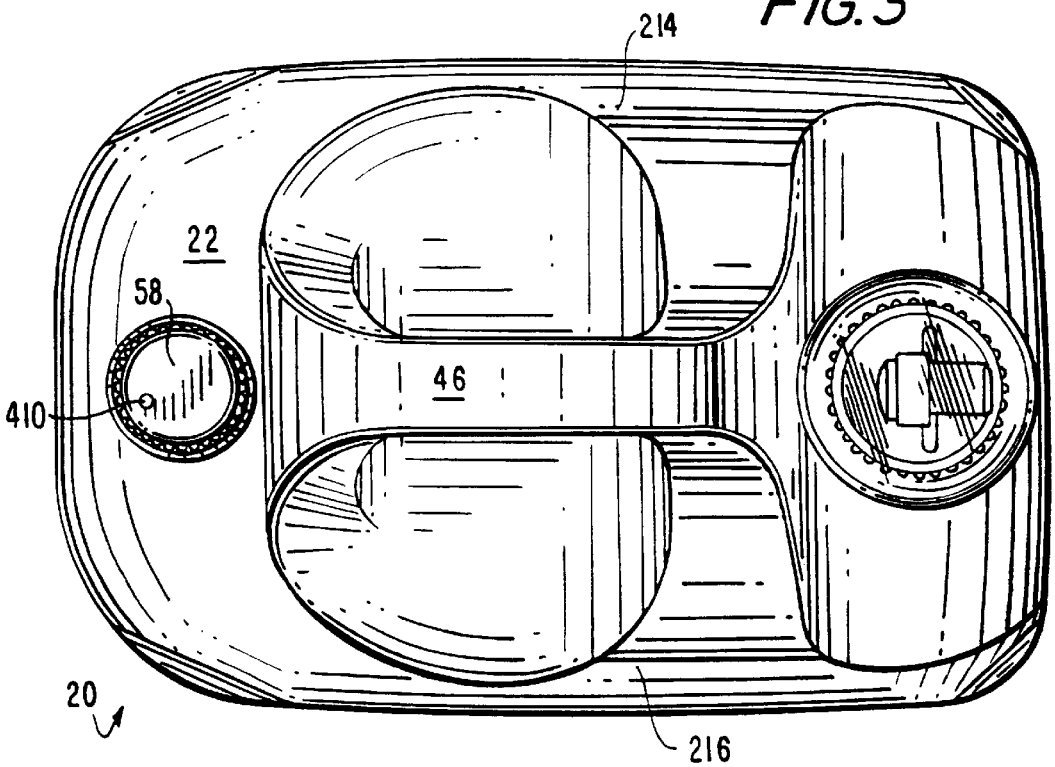
FIG. 3 is a top plan view of the container of FIG. 1.
Figure 4:
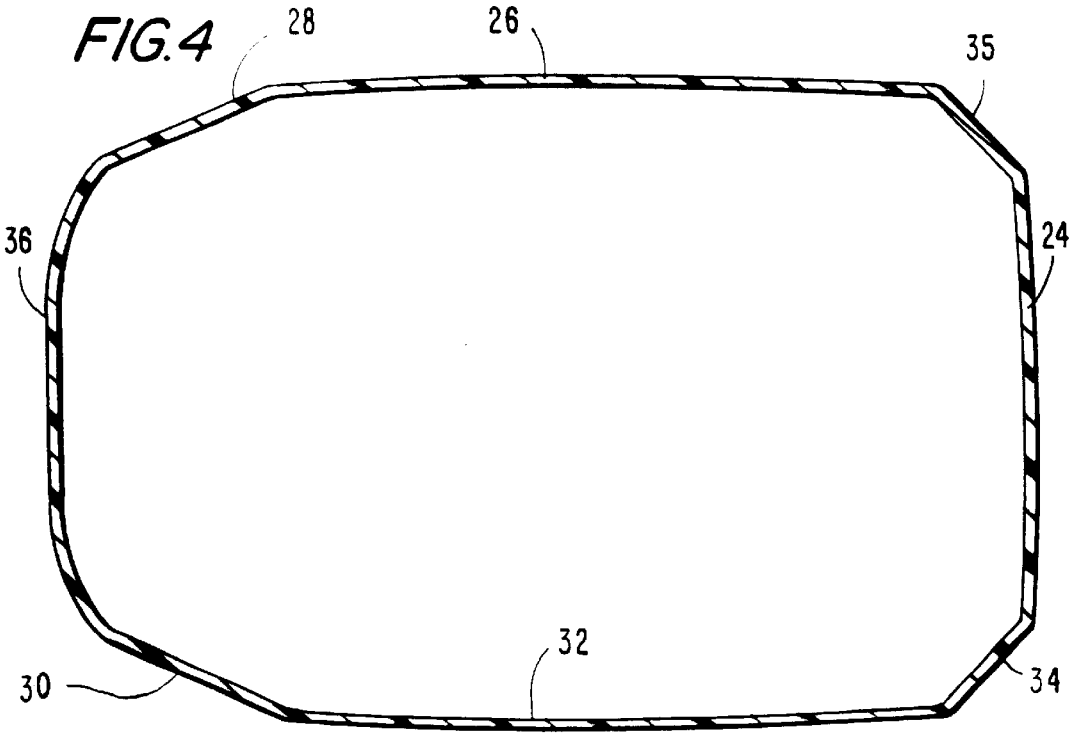
FIG. 4 is a cross section along the lines of 4—4 of FIG. 2.
Figure 5:
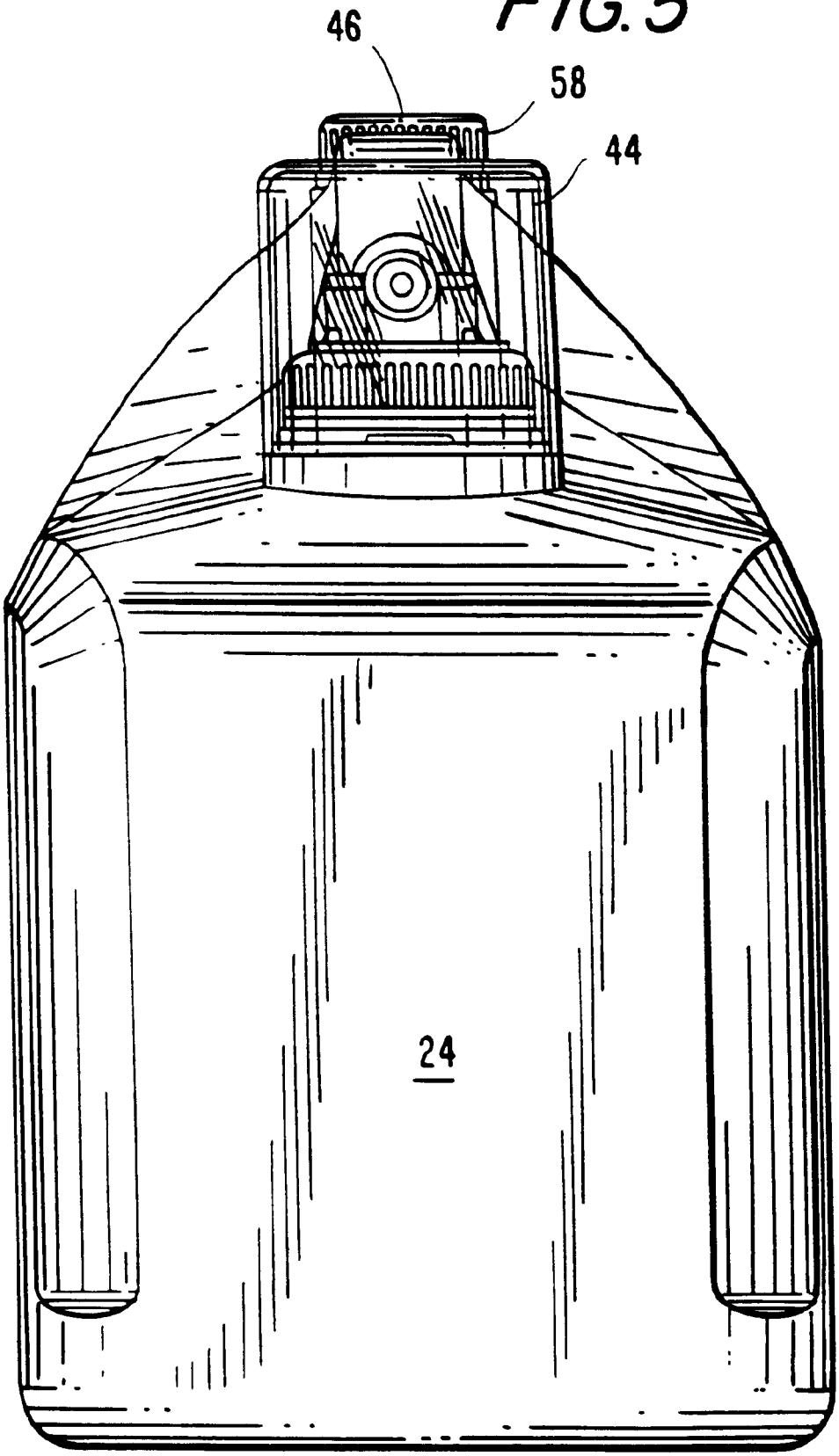
FIG. 5 is a front elevatonal view of the container of FIG. 1.
Figure 6:
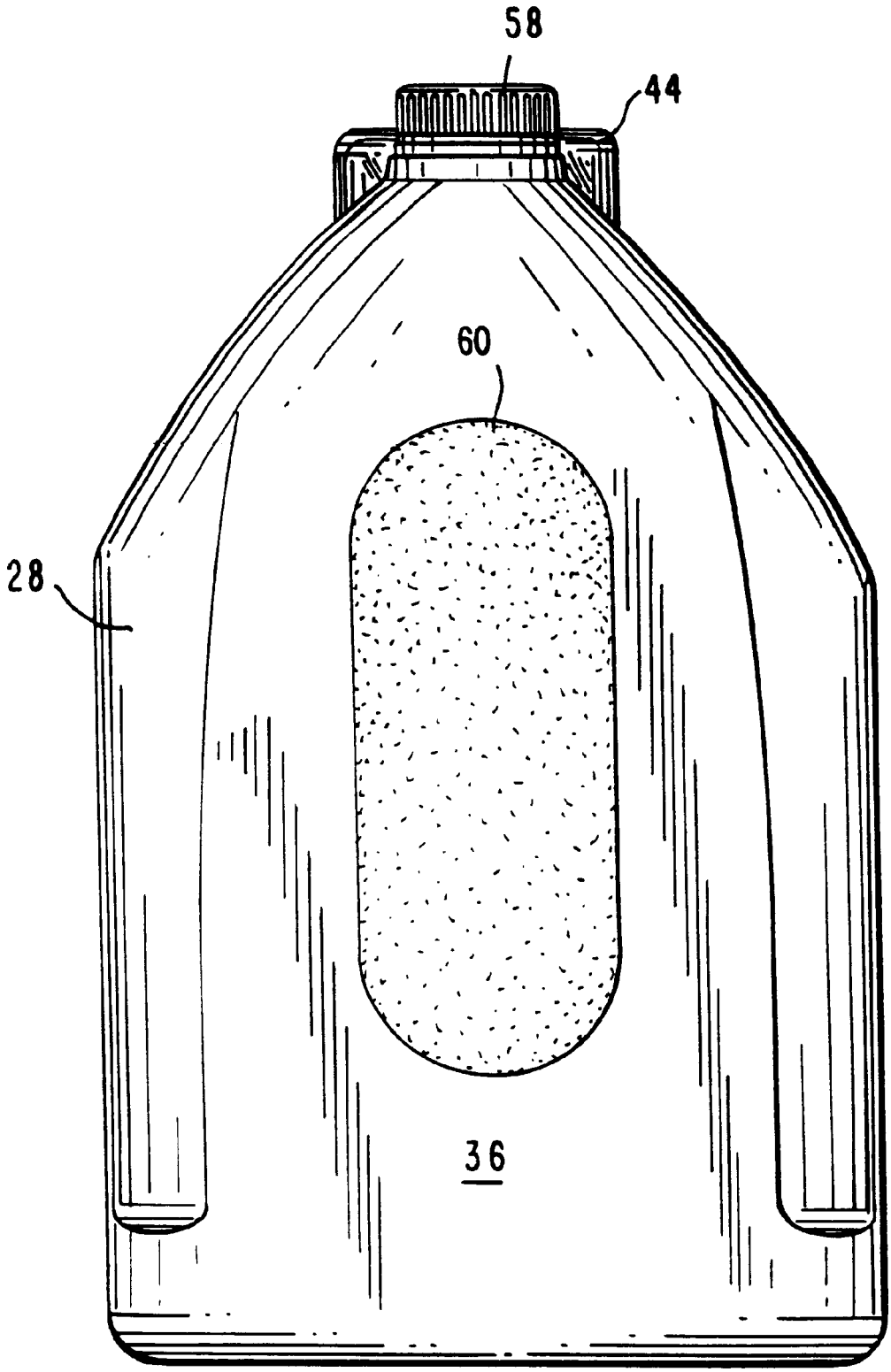
FIG. 6 is a rear elevational view of the container of FIG. 1.

As seen particulary in FIG. 2, the recessed area 40 in which the spigot assembly 42 is disposed is isolated from the interior aspect 50 of handle 46 by handle base 48. It is anticipated that isolation of the spigot area from the interior of the handle will prevent itinerant liquid product from migrating from the spigot area to the interior of the handle.

As can be seen especially in FIG. 2, the top surfaces of measuring cup 44, handle 46, and vent cap 58 are generally parallel. Moreover, the heights of the top surfaces of the measuring cup 44 and the vent cap 58 are independently within one inch of the top surface of handle 46, especially within 3/4 of an inch of the top surface of handle 46, and most preferably within 1/2 inch of the top surface of the handle 46. Keeping the top surfaces parallel and at approximately the same height facilitates the even distribution of top load of containers in that the effective top surface of the container seen by a container stacked on top of it will be more or less even whereby to prevent uneven stacking of the containers.

The handle and top wall of the container body include several features which it is believed contribute to an improved compressive strength. The forward and rear walls 210, 212 of the handle are generally curved rather than having rectilinear sides which meet at relatively sharp angles with each other or with the top wall 22.

Other features believed relevant to compressive strength include the fact that the base of the handle 48 at its front is in contact with the top wall of the container at a large number of points, extending e.g., from reference 214 on one side to 216 on the other, so that any force transmitted from above will be dissipated rather than concentrated at a few points. This is believed to make the container top wall, and therefore the container as a whole, less susceptible to failure. Indeed the width of the base at the handle's front end (measured along a horizontal axis, e.g., parallel to the op surface of the measuring cup/valve closure) is at least twice the width of the handle, preferably at least three times, still more preferably at least four or five times the width of the handle (also measured along a horizontal axis). In addition, the rear end of the handle merges curvedly with the elevated top wall 22 adjacent to the vent cap so that, again, any force transmitted from the handle is dissipated over a large area rather than concentrated at a few points.

As can be seen from the figures, the preferred package includes eight vertically extending side panels, including the front and rear walls. Use of six or more, especially use of eight or more side walls or panels is believed to enhance the compression strength of the container and to permit the use of less resource, e.g. thermoplastic polymers, in its manufacture. Use of less resource in manufacture in turn leads to less waste material after the useful life of the container is complete.

Figure 7:
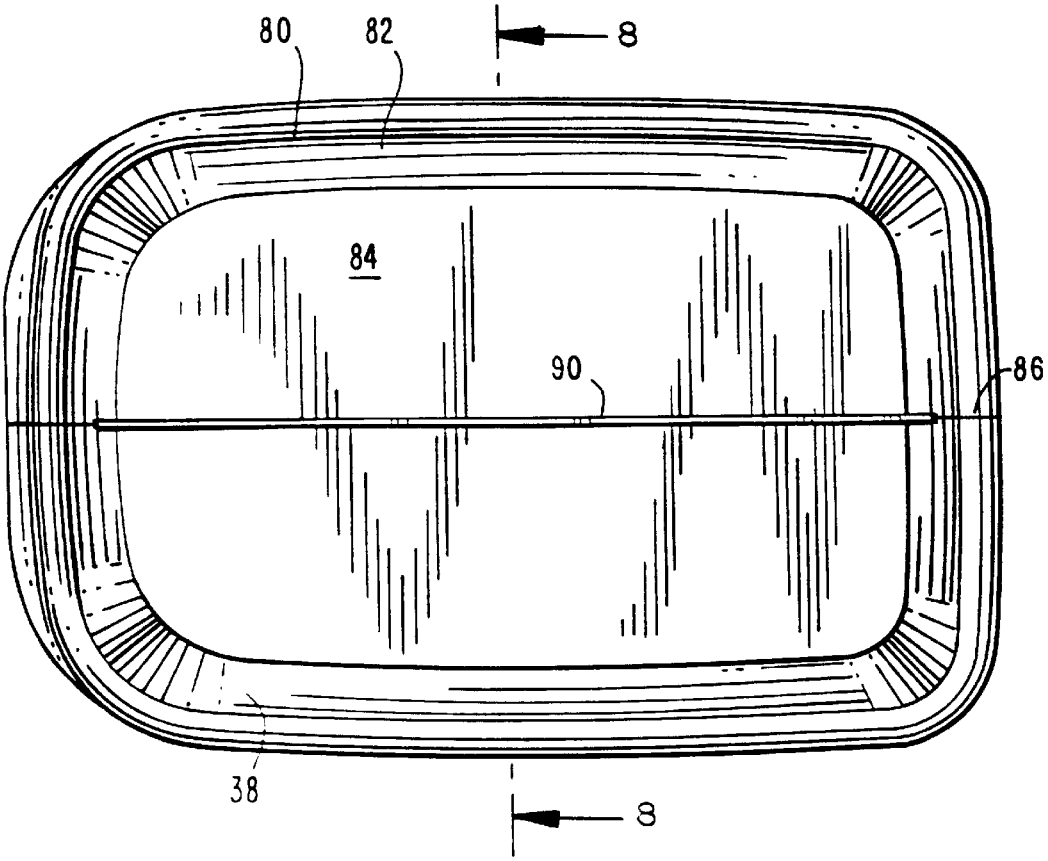
FIG. 7 is a bottom plan view of the container of FIG. 1.
Figure 8:
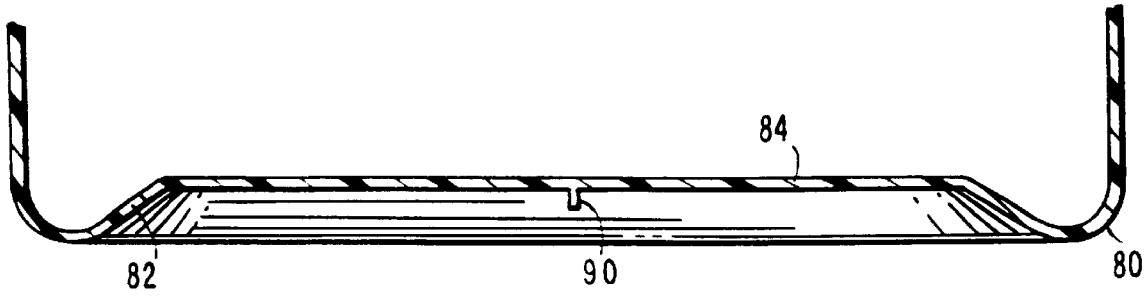
FIG. 8 is a cross section along the lines of 8—8 of FIG. 7.

Referring especially to FIGS. 7 and 8, bottom wall 38 includes outer rim 80 which comprises the primary support for the container. Heel 80 extends downwardly further than other aspects of the bottom wall 38. Wall 38 may include the base push-up construction shown in the FIG. 7 wherein an angled portion 82 is disposed inwardly of first ring 80 and medial aspect 84 of wall 38 is disposed further inwardly.

Parting line 86 (FIG. 7) is an artifact of container manufacture when the container is blow molded. Parting line 86 reflects the joining of two halves of the mold used to make the container. It may be desirable, as illustrated in FIGS. 7 and 8, to have a rib 90 of enhanced thickness and length at the parting line to provide support when the weight of the liquid product pushes downwardly on the medial aspect 84 of bottom wall 38. In such circumstances, rib 90 will assist in supporting the weight of the product. The structural support rib along the middle of the push-up is known per se and is also called the "pinch-off." As the push-up inverts due to the weight of the liquid contents, the rib may contact the flat surface and prevent further inversion of the push-up. Alternatively, there may be a series of parallel grooves in the bottle base's push-up to resist push-up inversion. The base push-up area may have one or two horizontally extending tiers for added strength, or may be waffled for increased strength.

Figure 9:
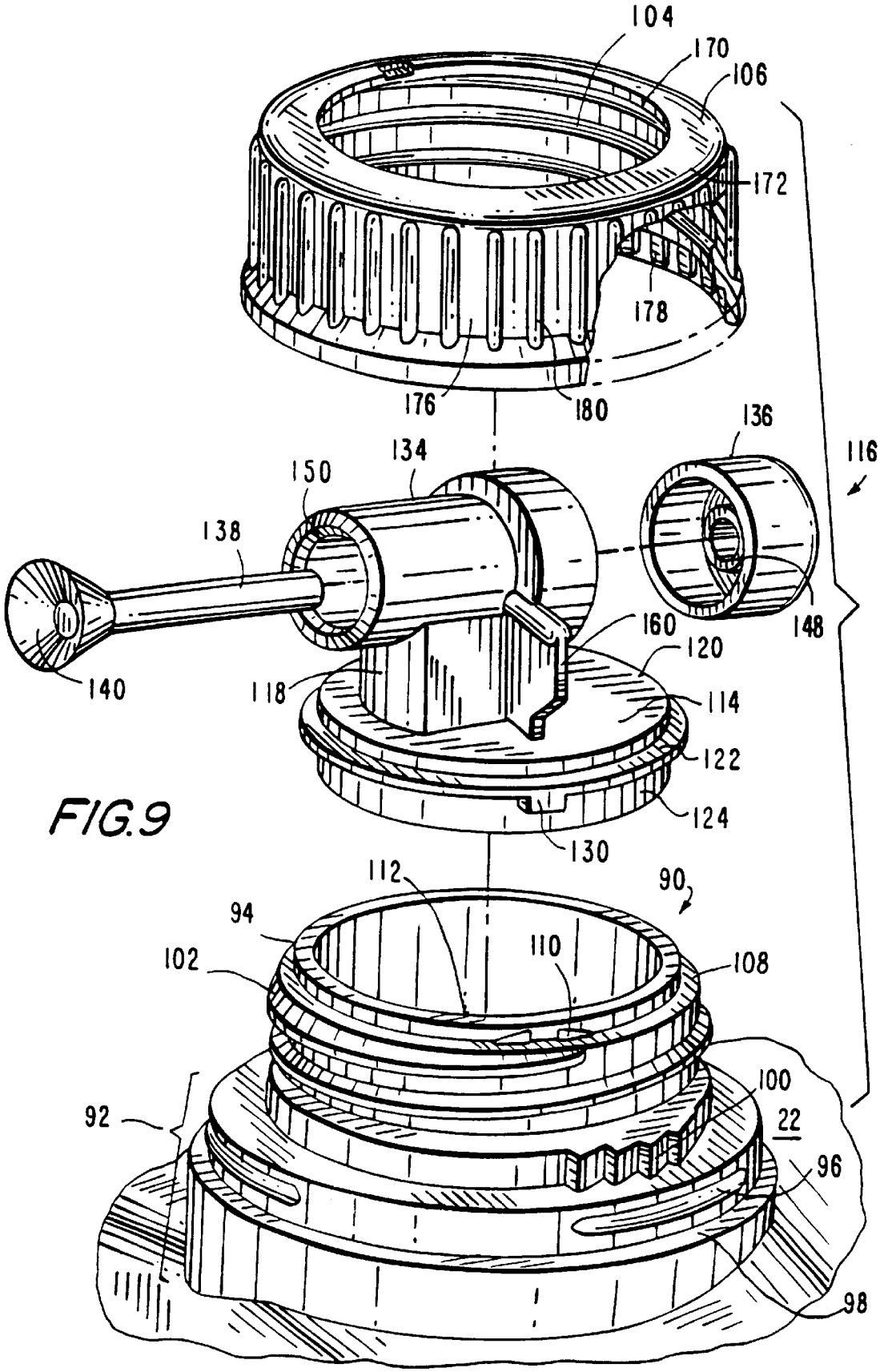
FIG. 9 is an exploded view of the pouring aperture, the pouring base, the pouring finish, the valve assembly and the valve collar.

Referring particularly to FIG. 9, top wall 22 has disposed therein annular dispensing opening 90. Dispensing opening 90 is supported by base 92 and by finish 94. Base 92 is generally circular and may include a plurality of levels as is illustrated in FIG. 9. In at least one level, elongated tabs 96 which are equally spaced from each other along the circumference of the base, serve to mate with a bead on the measuring cup, as will be described below. Below tab 96 a step 98 is provided in base 92 to support the measuring cup 44 when it is in place over the spigot assembly.

At the bottom of finish 94 are disposed two oppositely positioned sets of ratchets 100. Finish 94 is also provided with external threads 102 for mating with internal threads 104 on valve securement collar 106. Top thread 108 includes mirror image wedges 110, 112 which serve to facilitate alignment of valve base 114 when the spigot is in place by providing lug confining walls.

Valve base 114 includes spigot or valve 116, valve support column 118, spigot support platform 120, outer ring 122 and inner depending ring 124. Spigot support 114 is placed within dispensing aperture 90 by snap fitting inner ring 124 within the mouth of aperture 90. Outer ring 122 includes one or more oppositely disposed depending lugs 130, which are accommodated in a space between each of the mirror image wedges 110, 112. This facilitates the proper alignment of spigot supporting structure 114 and ultimately of spigot 116.

Figure 16:
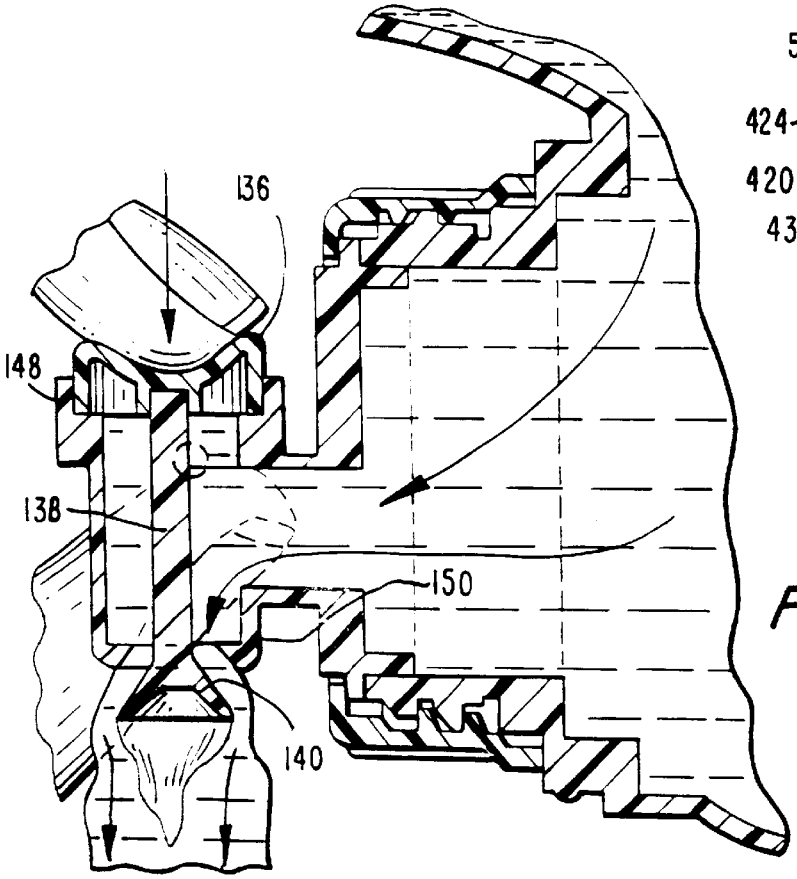
FIG. 16 is a cross section illustrating the pouring of product through the spigot of the present container.

Spigot 116 includes a valve mechanism of a type available from the David S. Smith Worldwide Dispensers of Merton, London of Great Britain. The spigot comprises spigot housing 134 resilient actuating button 136, valve stem 138, valve stem gripper 148 and valve 140. Operation of this simple valve is best seen with reference to FIGS. 14 and 16. In order to dispense product, the consumer rests the container on front wall 24 by pivoting the container forward along the front section of ring 80 of bottom wall 38. The consumer dispenses product by pressing the resilient actuator button 136, which receives valve stem 138 in circular retaining structure gripper 148. Preferably, gripper 148 is also resilient and slightly narrower than the diameter of the valve stem 148. The force applied by the consumer's finger is transmitted through valve stem 138 and forces valve 140 away from valve seat 150. This permits product to flow through the spigot and into the wash, or more preferably, into measuring cup 44.

Gripping wings 160, 162 are disposed on either side of valve housing 134 to permit the consumer to grasp the valve housing with two fingers while applying pressure with the thumb.

Figure 13:
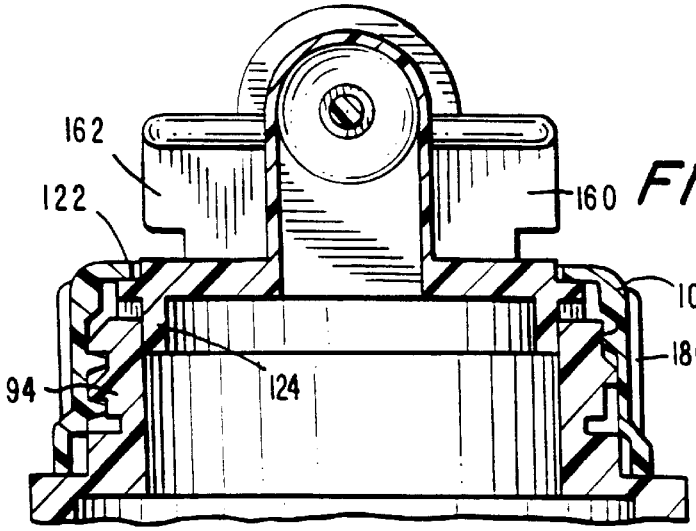
FIG. 13 is a cross sectional view along the lines 13—13 of FIG. 10.

As best seen in FIGS. 9 and 13, the spigot assembly 116 is secured to bottle finish 94 by spigot or valve collar 106. Internal threads 104 mate with external threads 102 on the bottle finish. Opening 170 on the spigot collar permits the spigot to extend outside of the collar. The top of the spigot collar includes flange 172 which rests upon outer ring 122 of the spigot base when the collar is secured in place on the spigot finish. Depending wall 176 of the spigot collar includes in addition to internal threads 104, lugs 178 which mate with ratchet 100 at the bottom of the spigot finish to secure more or less permanently the collar to the container.

The outside of spigot collar 106 may be provided with vertically extending ribs 180 to assist in rotating the collar when it is applied to the container.

To facilitate dispensing of product, it is preferred that the container include a vent 56 and vent cap or closure 58. The container may also be filled through the vent, if so desired with the closure removed. Vent 56 comprises vent finish 166 (FIG. 15) which may be threaded with external thread 168 to mate with internal thread 170 on vent cap 58.

Figure 15:
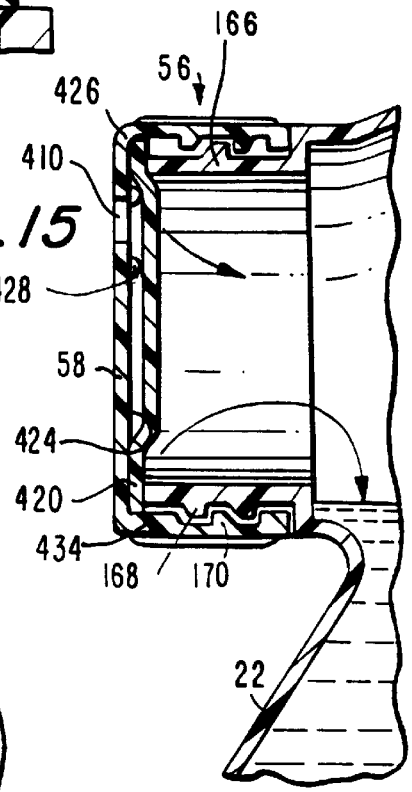
FIG. 15 is a cross section illustrating the venting of product through the vent hole and vent cap of the present invention.

Alternatively, the vent cap could be spin welded, sonically welded or adhered with hot melt or other adhesives, in which cases the threads may be omitted. As best seen in FIG. 15, vent hole 410 permits air to flow inwardly, through Gore-Tex fabric layer 420 as illustrated by the arrows in FIG. 15, and thereby to replace with air the volume of product lost when product is dispensed through pigot 116. Gore-Tex is available from W. L. Gore & Co. Liner 420 permits passage of air and other gases but not liquids such as the heavy duty liquid detergent contained within the package. Other materials may be used so long as they permit inward flow of air and prevent flow of liquids into or out of the container. In the illustrated embodiment, the vent opening finish is externally threaded and its external threads mate with internal threads on the vent closure. Alternatively, the vent closure may be a push/pull closure, disc-top or snap-top closure.

Figure 17:
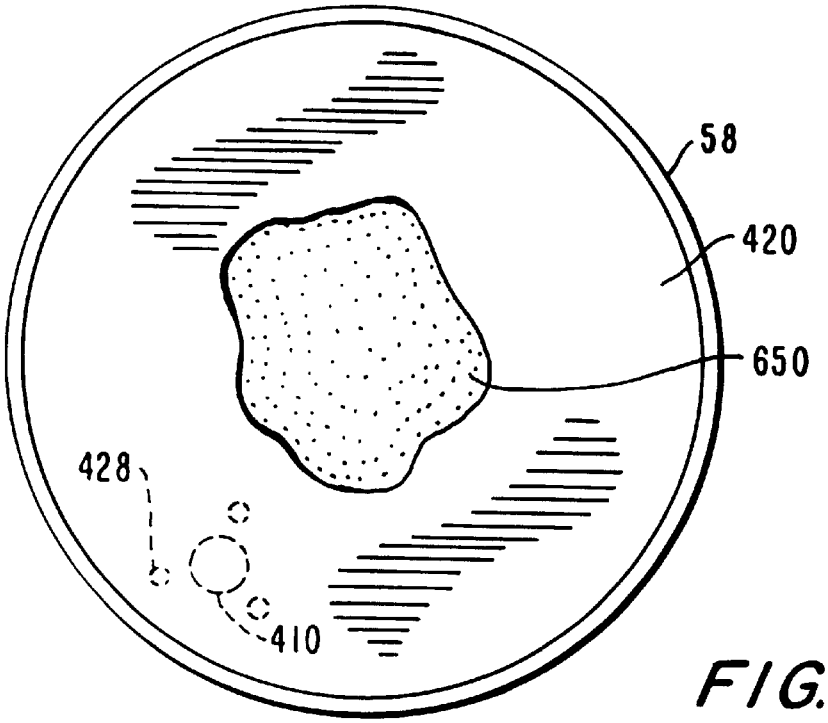
FIG. 17 is a cross section along the lines 17—17 of FIG. 14.
Figure 19:
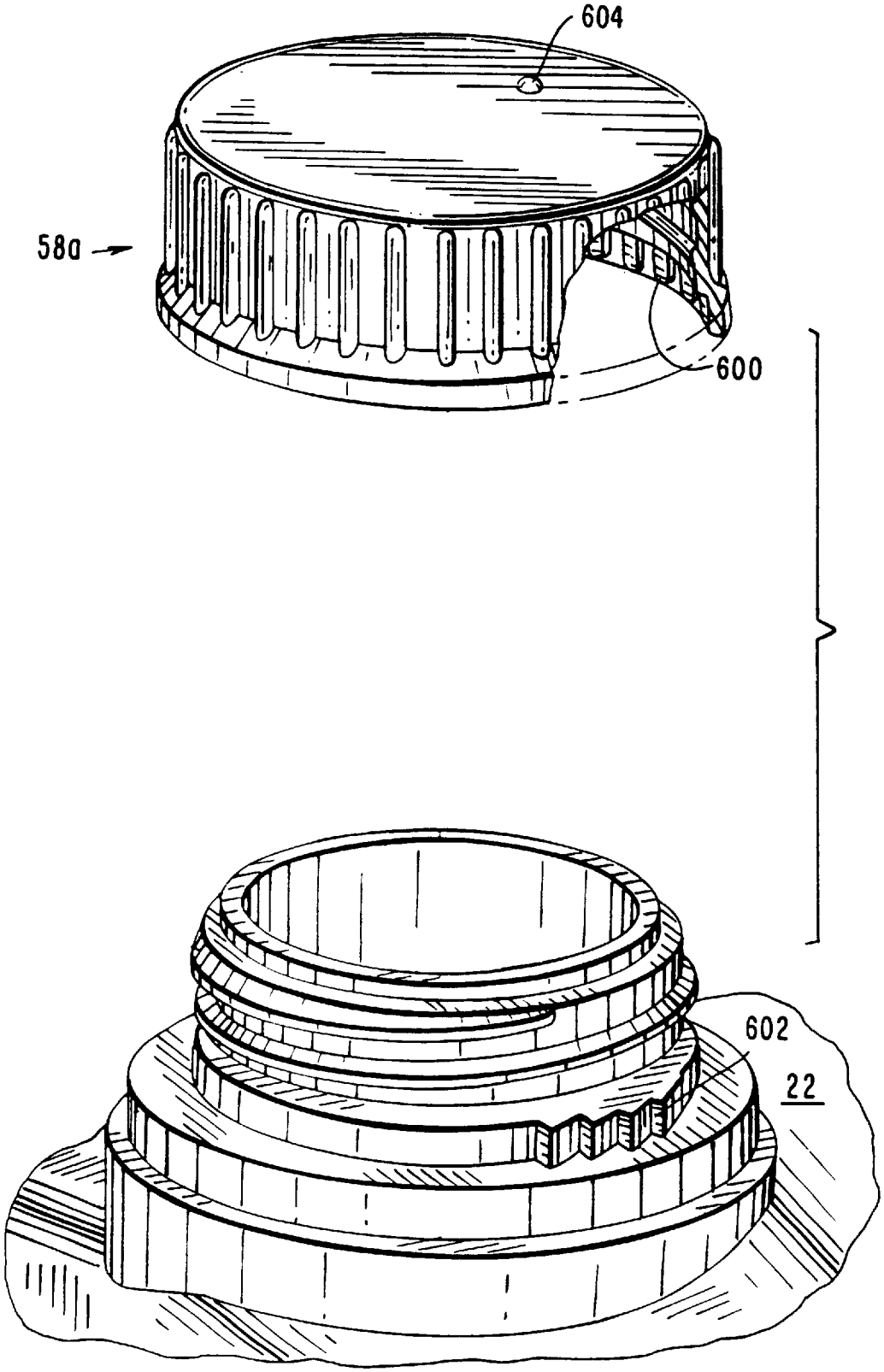
FIG. 19 is a perspective view of an alternative vent cap and vent cap finish according to the invention.

Liner 420 may be made of polytetrafluoroethylene or any other suitable lining material which permits passage of air but does not permit passage of liquids through the vent hole. As best seen in FIGS. 15 and 17, liner 420 is adhered to the surface of the bottom face 424 of top vent closure wall 426. Protuberances 428 extend downwardly from the inner or lower face of wall 426 in the vicinity of vent opening 410, thereby spacing liner 420 from wall 426 in the area of vent hole 410. Spacing of liner 420 from vent hole 410 has been found to be of importance in facilitating the intake of air during venting of the container. As an alternative, liner 420 can be friction fit within the confines of depending circular wall 434 of vent cap 58. Where threads are used to secure vent cap 58 to vent finish 166, ratchets may be employed to prevent removal of cap 58 by consumers once it has been secured to vent finish 166, so as to avoid the possibility of leakage in the event that the cap is opened. FIG. 19 shows a vent cap 58*a* having vent 604 and lugs 600 and vent finish with ratchets 602 which mate with the lugs. In any event, once the container has been filled the vent cap is preferably secured to the container sealingly and permanently so that it can not be loosened by consumers to permit escape of liquid product.

Examples of other materials which are suitable for layer 420 are nylon, polypropylene, polyester and high and low density polyethylene.

Instead of the rounded protuberances or dimples 428 illustrated, other spacers may be utilized in appropriate circumstances, such as a spacing ring. Advantageously, where discontinuous spacers are used, the spacer is present at least at three spaced points along the periphery of the vent opening so as to keep liner 420 spaced from the entire vent hole, if possible.

Figure 18:
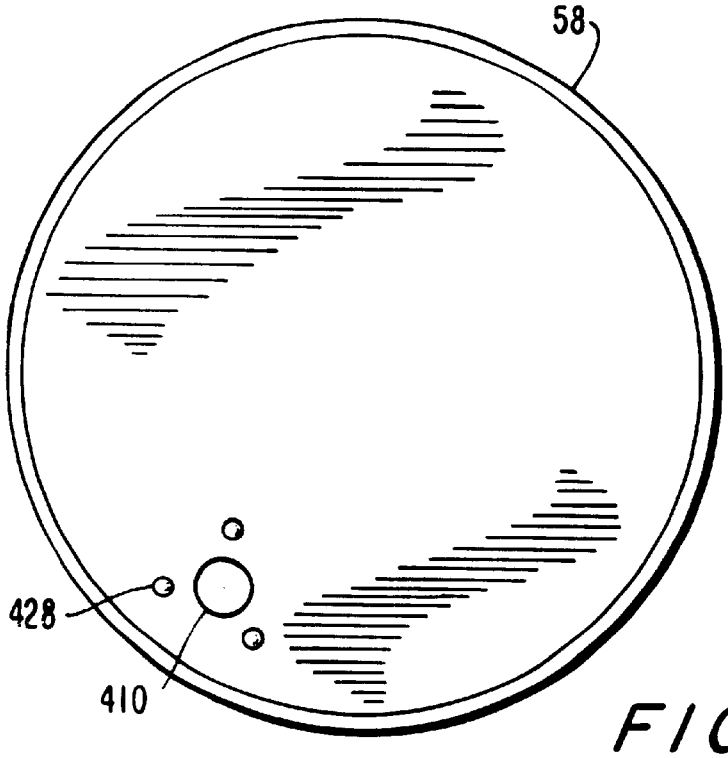
FIG. 18 is a view similar to FIG. 17 except that the liner has been removed.

Vent hole 410 and the protuberances 428 and adhesive 650 are seen in phantom in FIG. 17 underneath liner 420. In FIG. 18, liner 420 has been removed to illustrate the vent hole and protuberances more clearly.

Figure 14:
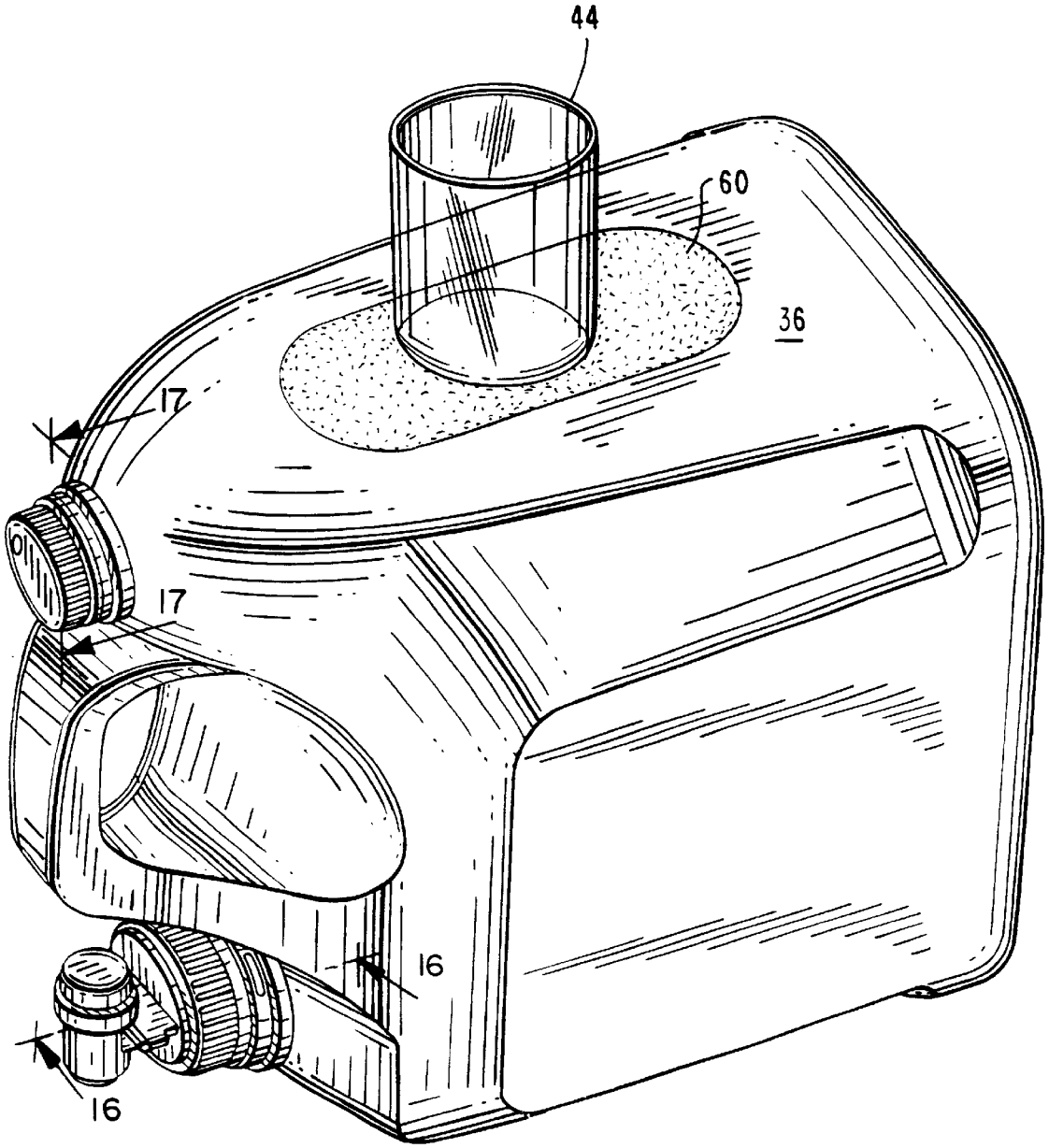
FIG. 14 is a perspective view of the bottle of FIG. 1 in the pouring position.

It will be appreciated that when the container is in its dispensing position resting on front wall 24, it may be desirable to rest momentarily measuring cup 44. Since it is envisioned that the container may be made of a material, such as certain thermoplastics, which is relatively smooth, in accordance with the invention, a non uniform section may be provided within one of the walls to assist in maintaining the cup in its position while it is disposed on the container. An example is illustrated in FIG. 14 wherein surface 60 which has a racetrack-like periphery, has been etched into rear wall 36. This is expected to minimize any tendency of measuring cup 44 to slip or slide on the surface of the container. Front panel 24 includes a large flat area to provide a stable base and to resist rocking during the dispensing operation. The side of the bottle adjacent the top vent closure becomes the top of the bottle in the dispensing position. This panel 36 is flat and level and has the textured surface wherein the measuring cup can be placed between uses in the upright position.

Measuring cup 44 serves the dual function of measuring cup and closure for the spigot assembly. Measuring cup 44 is releasably secured to the container in its inverted position by being snap fit over equi-spaced ribs or lugs 96, which mate with bead 190 at the mouth of the cup. Alternatively, the measuring cup can be secured to the bottle base finish by use of a continuous thread to screw on the bottle base finish or by other means.

The cup's annular bead and the bottle's three or more lugs are designed to stay engaged during the impact of case packing as well to as withstand the rigors of shipping and warehousing without becoming dislodged.

The container may be mono-layer or multi-layer and may be made of HDPE, PP, PVC, PET, POLYCARBONATE or acrylic or nitrite base resins, and preferably contains a minimum of 25% PCR.

Preferably, the measuring cup has textured fill line bands etched into the interior of the cup to aid the consumer visually in filling to the proper dose. The measuring cup may have a v-groove channel on the exterior of the mouth, similar to a laboratory beaker, to aid in pretreating strains with precise pouring. This channel could have an anti-drip lip. Alternatively, there may be "V" or "U" notches in the top side wall for a controlled pour.

If so desired, the measuring cup can include a handle. The measuring cup could have an exterior, annular anti-drip lip.

The container or bottle of the inventions may be pigmented opaque or may be made clear by fabricating it from clarified grades of the aforementioned resins.

In addition to the vertical side panels, including the side panels at the vertical corner intersections, there may be other strengthening vertical design features such as outer ribs or inner grooves either at the corner intersections or elsewhere in the side panels, or at in both locations.

The bottle, valve, valve collar and vent closure may be made of anti-static grades of the aforementioned resins. The tap collar and vent closure are preferably made of a polyolefin resin, most preferably PP. Preferably, the pigmented tap body is the same color as the pigmented tap collar and vent closure. Alternatively, these components may be clear and the measuring cup could be opaque.

Preferably, the front and back panels of the bottle include in-mold labels (IML labels), preferably plastic IML's. Plastic IML's may be opaque or clear. Polypropylene (PP) IMLs may be used to reduce blistering given that the containers of the invention may have a relatively large label area. Alternatively, instead of an IML, there may be a stretch or shrink label which act like a "girdle" to resist bottle bulging with these labels. Also, the bottles front/back panels may be waffled.

There may be indicia cut into the molds and/or embossed on the molded bottle and vent closure which give instructions on use.

In an alternative design, the vent closure and the second bottle neck finish are in the same horizontal place as said first neck finish. In this configuration, the measuring cup may be attached to lugs at the base of the second neck finish and positioned over the vent closure.

To avoid label scuffing, the base of the bottle could be larger in length and thickness than the label panel's greatest length and thickness, so that labels would not contact the walls of the corrugated shipping container or the label of another bottle.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A venting closure comprising:

(a) a top wall, (b) a venting opening in said top wall, (c) said wall having an outer face and an inner face having a surface, (d) at least two spacers on said wall inner face, and (e) a depending cylindrical side wall adjacent said first face, (f) a liner adjacent said inner face and spaced from said venting opening by said spacers, said liner being of a material which permits air to pass through the vent hole, said liner being adhered to a portion of said inner face surface.

2. The vent according to claim 1 wherein said liner is of a material which does not permit liquids to pass through said vent hole.

3. The vent according to claim 1 wherein said liner is of a material which does not permit liquid detergents to pass through said vent hole.

4. The vent according to claim 1 wherein vent is a vent cap and said wall further comprises a depending cylindrical side wall adjacent said first face and having fasteners for fastening to a container.

5. The vent according to claim 1 wherein said one or more spacers are comprised of protuberances.

6. The closure according to claim 1 wherein said spacer are comprised of protuberances.

7. The closure according to claim 1 wherein said liner is comprised of polytetrafluoroethylene.

8. The vent according to claim 7 wherein said liner is comprised of unsintered, fibrillated tetrafluoroethylene polymer.

9. A container comprising a top wall, a side wall, a bottom wall, a container venting opening in at least one of said top and side walls, a venting closure adapted to close said venting opening, said venting closure comprising: a top closure wall, a closure venting opening in said top closure wall, said top closure wall having an outer face and an Inner face having a surface, spacers comprising a plurality of protuberances on said wall inner face, and a depending cylindrical side wall adjacent said inner face, a liner adjacent said inner face and spaced from said venting opening by said spacers, said liner being of a material which permits air to pass through the vent hole, said liner being partly adhered to said inner face surface.

10. The container according to claim 9 wherein said liner is of a material which does not permit liquids to pass through said vent hole.

11. A The container according to claim 9 further comprising a further opening suitable for dispensing product from the container.

12. The container according to claim 11 wherein said container further comprises a spigot for releasing product from said product dispensing opening and said container.

13. The container according to claim 12 wherein said container includes one or more upper walls and said one or more upper walls comprise said spigot, said product dispensing opening, and a handle.

14. A container comprising a top wall, a side wall, a bottom wall, a container venting opening in at least one of said top and side walls, a venting closure adapted to close said venting opening, said venting closure comprising: a top closure wall, a closure venting opening in said top closure wall, said top closure wall having an outer face and an inner face, a liner adjacent said inner face, said liner being of a material which permits air to pass through the vent hole, a further opening suitable for dispensing product from the container a spigot for releasing product from said product dispensing opening and said container said container including one or more upper walls and said one or more upper walls comprising said spigot, said product dispensing opening, and a handle.

15. The container according to claim 14 wherein said liner is of a material which does not permit liquids to pass through said vent hole.

16. The container according to claim 14 wherein said liner is adhered to at least a portion of said inner face.

17. The container according to claim 14 wherein said liner is friction fit within said cylindrical wall.

18. A container comprising a top wall, a side wall, a bottom wall, a container venting opening in at least one of said top and side walls, a venting closure adapted to close said venting opening, said venting closure comprising: a top closure wall, a closure venting opening in said top closure wall, said top closure wall having an outer face and an inner face having a surface, spacers comprising a plurality of protuberances on said wall inner face, and a depending cylindrical side wall adjacent said inner face, a liner adjacent said inner face and spaced from said venting opening by said spacers, said liner being of a material which permits air to pass through the vent hole, said liner being partly adhered to said inner face surface, said container further comprising a further opening suitable for dispensing product from the container, said container further comprising a spigot for releasing product from said product dispensing opening and said container, said container includes one or more upper walls and said one or more upper walls comprise said spigot, said product dispensing opening, and a handle.

* * * * *